US010385521B1

(12) United States Patent
Boston et al.

(10) Patent No.: US 10,385,521 B1
(45) Date of Patent: Aug. 20, 2019

(54) PAVING MACHINE WITH AN EMULSION TANK

(71) Applicant: Caterpillar SARL, Geneva (CH)

(72) Inventors: Timothy Boston, Washington, IL (US); Andrea Fontana, Porto Tolle-Rovido (IT)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 15/976,509

(22) Filed: May 10, 2018

(51) Int. Cl.
*E01C 19/08* (2006.01)
*E01C 19/17* (2006.01)
*E01C 19/18* (2006.01)
*E01C 19/48* (2006.01)

(52) U.S. Cl.
CPC ..... *E01C 19/174* (2013.01); *E01C 19/08* (2013.01); *E01C 19/18* (2013.01); *E01C 19/48* (2013.01)

(58) Field of Classification Search
CPC ..... E01C 19/08; E01C 19/12; E01C 23/14
USPC ..... 404/95, 111
See application file for complete search history.

(56) References Cited

U.S. PATENT DOCUMENTS 1,613,051 A * 1/1927 Napier ..... E01C 19/21 105/282.1
3,401,890 A * 9/1968 Middlesworth ..... A01M 7/0089 239/156
4,445,848 A * 5/1984 Heller ..... C10C 3/007 126/343.5 A
4,678,363 A * 7/1987 Sterner ..... E01C 19/21 404/113
5,186,396 A * 2/1993 Wise ..... B05B 9/06 239/675
5,267,696 A * 12/1993 Balmer ..... A01M 11/00 239/172
5,324,136 A 6/1994 Reymonet et al.
5,419,654 A * 5/1995 Kleiger ..... E01C 19/46 366/22
5,851,085 A * 12/1998 Campbell ..... E01C 19/174 404/75
6,109,826 A * 8/2000 Mertes ..... E01C 19/45 392/472
6,173,904 B1 * 1/2001 Doherty ..... A01C 17/00 239/1
7,497,641 B1 * 3/2009 Frelich ..... E01C 19/48 172/611
8,025,459 B2 * 9/2011 Buschmann ..... E01C 19/48 404/108
8,061,931 B2 11/2011 Musil
8,308,394 B2 * 11/2012 Whitley ..... E01C 23/06 404/75
8,376,654 B2 * 2/2013 Kleiger ..... E01C 23/06 134/10
9,689,117 B2 6/2017 Bartoszek
(Continued)

FOREIGN PATENT DOCUMENTS

EP 0292337 B1 8/1990
JP 2007303189 A 11/2007
(Continued)

*Primary Examiner* — Gary S Hartmann
(74) *Attorney, Agent, or Firm* — Bookoff McAndrews

(57) ABSTRACT

A paving machine includes an engine assembly, a hopper to receive or store paving material, and a tank to store and dispense emulsion fluid. The tank is positioned between the engine assembly and the hopper.

17 Claims, 5 Drawing Sheets

(56) References Cited

U.S. PATENT DOCUMENTS

2016/0123819 A1* 5/2016 Becher ..... B60P 3/00
374/141

FOREIGN PATENT DOCUMENTS

JP 04407967 B2 2/2010
JP 04721866 B2 7/2013

* cited by examiner

PAVING MACHINE WITH AN EMULSION TANK

TECHNICAL FIELD

The present disclosure relates generally to a road construction machine, and more particularly, to a paving machine with an emulsion tank.

BACKGROUND

The present disclosure relates to paving machines that are used in road surface construction and repairs. Paving machines are typically utilized to lay asphalt or other paving material. Paving often includes a tanker truck delivering a pre-coating tack, emulsion fluid, or other treatment fluid on the existing ground or road surface to aid in the bonding of the new paving material. The paver machine then applies a new layer of paving material over the treatment fluid. However, because the tanker truck is usually pushed in front of the paver machine, the paver machine passes over the treatment fluid and leaves tracks in the treatment fluid. Additionally, it is important to maintain an appropriate temperature within an emulsion tank, but typical paving machines require draining and disassembly of the tank in order to inspect, clean, repair, or replace a heating element.

U.S. Pat. No. 8,061,931, issued to Musil on Nov. 2, 2011 ("the '931 patent"), describes a pre-coating system and method for hot mix asphalt paving. The paving system uses an emulsion cart deployed ahead of a paver machine. The emulsion cart of the '931 patent is coupled to a forward spray bar that sprays an emulsion fluid on a ground surface located between the wheels of the paver machine to avoid the paver machine leaving tracks in the emulsion fluid. The emulsion cart is also coupled to rear spray bars for spraying emulsion fluid on the ground surface behind the wheels of the paver machine. The emulsion cart of the '931 patent is a separate piece of machinery pushed ahead of the paver machine, rather than being built into the paver machine. The emulsion cart of the '931 patent may impair or inhibit the delivery of paving material to the paving machine, or may limit the operator's visibility in front of the paving machine. The paving machine of the present disclosure may solve one or more of the problems set forth above and/or other problems in the art. The scope of the current disclosure, however, is defined by the attached claims, and not by the ability to solve any specific problem.

SUMMARY

In one aspect, a paving machine may include an engine assembly, a hopper to receive or store paving material, and a tank to store and dispense emulsion fluid. The tank may be positioned between the engine assembly and the hopper.

The paving machine may include any of the following aspects. The tank may include a heater cavity that is fluidly isolated from an interior of the tank. The heater cavity may be accessible from an exterior of the tank via a heater panel located on a side of the paving machine. The heater cavity may be connected to one or more heater compartments that extend into the interior of the tank to receive one or more heater elements from the heater cavity to heat the emulsion fluid stored within the tank, and the heater compartments may be fluidly isolated from the interior of the tank. The tank may include a pump cavity that is fluidly isolated from an interior of the tank. The pump cavity may be accessible from an exterior of the tank via a pump panel located on a side of the paving machine. The paving machine may further include a heater cavity, and both the pump cavity and the heater cavity may extend from a bottom wall of the tank.

The pump cavity may include a pump that includes a plurality of inlets and outlets in order to fluidly couple the tank to an emulsion spray bar or to an external fluid supply. The pump may include an internal fluid inlet and an internal fluid outlet fluidly connected to the interior of the tank. The pump may include an external fluid inlet and an external fluid outlet that are positioned exterior to the tank. The pump may include one or more tube valves that are movable to configure the fluid flow to and from the pump, and each tube valve may include a plurality of indicators positioned on a tube valve stem. The pump may further include one or more sensors positioned adjacent to the pump, and the one or more sensors may detect the configurations of the one or more tube valves. The pump may be controllable to recirculate the emulsion fluid within the tank, to deliver the emulsion fluid from the tank to the emulsion spray bar, to deliver a fluid from an exterior source to the tank, and to deliver the fluid from the exterior source directly to the emulsion spray bar without passing through the tank.

The paving machine may further include a supply of compressed air, and the supply of compressed air may be coupled to the emulsion spray bar. The paving machine may further include at least two fluid inlets positioned on a top portion of the tank. The at least two fluid inlets may be positioned on opposite sides of the tank relative to a central axis of the paving machine. The at least two fluid inlets may be each coupled to a tube that extends into an interior of the tank. One or more dividers may be coupled to the interior of the tank to support or separate the tubes. The paving machine may further include at least one sensor positioned within the tank. The at least one sensor may be connected to a light positioned outside of the tank. When the sensor detects an condition outside of a predetermined range, the light may illuminate or change color to indicate the sensed condition.

In another aspect, a tank for a paving machine may include an interior cavity to receive or store a fluid, a heater cavity, and a pump cavity. The heater cavity may be positioned on a first side portion of the tank, and may be connected to one or more heater compartments that extend into the interior cavity of the tank. The heater cavity and heater compartments may be fluidly isolated from the interior cavity. The pump cavity may be positioned on a second side portion of the tank opposite to the first side portion. The pump cavity may be fluidly isolated from the interior cavity. The pump cavity may include a pump with a plurality of inlets and outlets in order to fluidly couple the interior cavity of the tank to a spray bar or to an external fluid supply.

The tank may include any of the following aspects. The tank may further include at least two fluid inlets positioned on a top portion of the tank. The at least two fluid inlets may be positioned on opposite sides of the tank relative to a central axis of the paving machine, and the at least two fluid inlets may be each coupled to a tube that extends into an interior of the tank. The pump may include an internal fluid inlet and an internal fluid outlet fluidly connected to the interior of the tank. The pump may include an external fluid inlet and an external fluid outlet that are positioned exterior to the tank. The pump may be controllable to recirculate the fluid within the tank, to deliver the fluid from the tank to the spray bar, to deliver a fluid from an external fluid supply to the tank, and to deliver the fluid from the external fluid supply directly to the spray bar without passing through the tank.

In a further aspect, a system for a paving machine may include a tank for emulsion fluid, including a pump housed in a pump cavity within the tank and one or more heaters at least partially housed in a heater cavity within the tank. The pump cavity and the heater cavity may be fluidly isolated from an interior of the tank, and the pump may include a plurality of inlets and outlets that fluidly connect at least the tank to a spray bar. The system may also include a control panel. The control panel may be wired or wirelessly connected to the pump and to the one or more heaters. The control panel may be configured to control the delivery of the emulsion fluid from the tank to the spray bar and a temperature of the emulsion fluid by controlling the current through the one or more heaters.

The system may include any of the following aspects. The system may further include one or more heater compartments extending from the heater cavity into the interior of the tank. A majority of each heater may be positioned within the one or more heater compartments. The pump may include an internal fluid inlet and an internal fluid outlet fluidly connected to the interior of the tank. The pump may also include an external fluid inlet and an external fluid outlet that extend exterior to the tank. The pump may further include one or more valves to control the pump to recirculate the fluid within the tank, to deliver the fluid from the tank to the spray bar, to deliver a fluid from an external fluid supply to the tank, and to deliver the fluid from the external fluid supply directly to the spray bar without passing through the tank.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces that form typical roadways (e.g., asphalt, cement, clay, sand, dirt, etc.) or upon which paving material may be deposited in the formation of roadways. In this disclosure, relative terms, such as, for example, "about," "substantially," and "approximately" are used to indicate a possible variation of ±10% in a stated value. Although the current disclosure is described with reference to a paving machine, this is only exemplary. In general, the current disclosure can be applied as to any machine, such as, for example, a paver finisher, asphalt finisher, or another paving-type machine.

Figure 1:
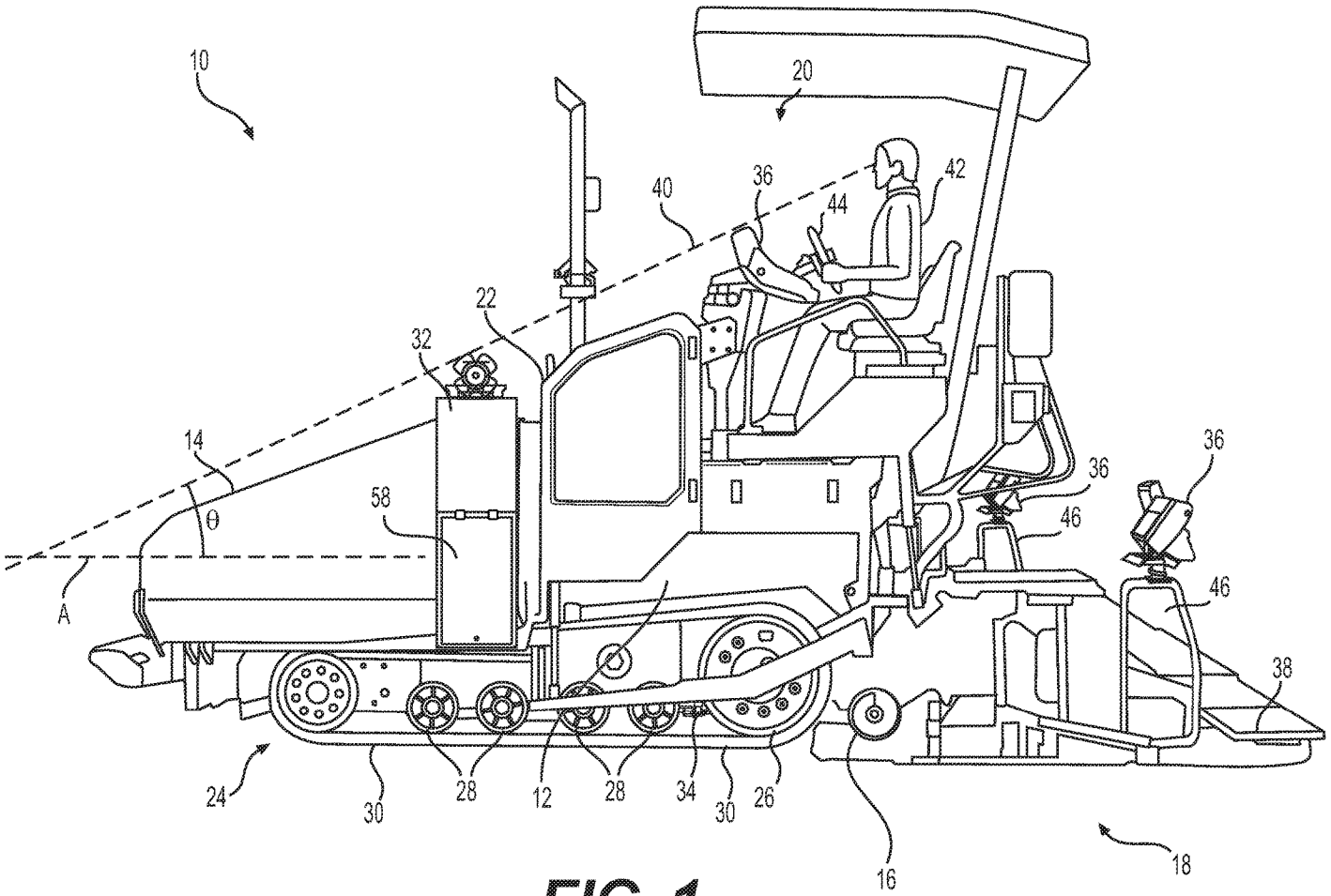
FIG. 1 is an illustration of one configuration of an exemplary machine, according to aspects of this disclosure.

FIG. 1 illustrates a side view of an exemplary paving machine 10, according to the present disclosure. Machine 10 may be a small paver, for example, with a maximum paving width of approximately 5.5 meters. Machine 10 includes a frame 12, a hopper 14, an auger 16, and a screed 18. Machine 10 may also include an operator station 20, including one or more controls or displays to maneuver, control, and monitor machine 10. Machine 10 may include an engine assembly 22 to power a drive assembly 24, including a drive wheel 26, one or more idlers 28, and a track 30 on each side of machine 10. Additionally, machine 10 includes a tank 32 and a spray bar 34. Tank 32 may contain a treatment fluid or emulsion fluid, for example, a binding material, to be delivered to the ground surface by spray bar 34 prior to delivery of the paving material via auger 16 and screed 18. The delivery of the emulsion fluid may be controlled or monitored by a user via a control panel 36 mounted in an operator position 38 on screed 18 or operator station 20. Additionally, as shown, tank 32 may not substantially inhibit a sightline 40 of an operator 42 positioned in operation station 20. In one aspect, sightline 40 may extend from a point in front of machine 10 at an angle θ, for example, 45 degrees, from a longitudinal axis A of machine 10 to a portion of operator 42 (e.g., the eyes of operator 42). As shown in FIG. 1, the positions and shapes of hopper 14, engine assembly 22, and tank 32 may help to ensure that operator 42 has a clear sightline 40 from operator station 20.

Hopper 14 is positioned in a forward portion of frame 12 to receive or store the paving material, for example, from a mixer truck. Although not shown, a conveyor assembly connects hopper 14 to auger 16 in a rear portion of frame 12 to convey the paving material. The conveyor assembly may extend beneath tank 32, engine assembly 22, and operator station 20, and may be positioned above spray bar 34.

Auger 16 may be positioned perpendicular to the direction of travel of machine 10. Additionally, auger 16 may include a plurality of parallel or longitudinally arranged auger sections. Screed 18 is positioned to the rear of auger 16, and smooths the paving material delivered by auger 16 to the ground surface. Screed 18 may further include one or more operator positions 38, which may include control panels 36. The height of screed 18 may be adjustable, for example, via control panel 36. Operator station 20 may include a steering wheel 44 and a plurality of user interfaces, including a control panel 36, in order for an operator to steer machine 10, control a rate of delivery of the paving material, adjust the height of screed 18, control the delivery of emulsion fluid via spray bar 34, etc.

As shown in FIG. 1, tank 32 may be positioned between hopper 14 and engine assembly 22. Tank 32 may include a height that is substantially the same as or between the heights of hopper 14 and/or engine assembly 22. Tank 32 may minimally reduce the capacity of hopper 14, but tank 32 may also enable machine 10 to carry a supply of emulsion fluid without interfering with sightline 40 of operator 42. Spray bar 34 may be positioned between drive wheel 26 and one of idlers 28, for example, a rearmost idler 28. Moreover, although not shown, machine 10 may include one or more additional spray bars positioned to the rear of drive assembly 24, for example, to spray the ground surface to the rear of tracks 30. Spray bar 34 and the additional spray bars may be fluidly coupled to tank 32 to deliver the emulsion fluid.

The one or more control panels 36 may be mounted in operator station 20 and/or in operator positions 38 on screed 18. For example, one control panel 36 may be positioned on a dashboard next to a steering wheel 44 in operator station 20. Additionally or alternatively, one or more control panels 36 may be mounted on one of rails 46 at a rear portion of screed 18. An operator may stand on screed 18 at one of operator positions 38, for example, on a left and a right side of screed 18, and monitor, adjust, or otherwise control various functions of machine 10 via control panel 36.

Figure 3:
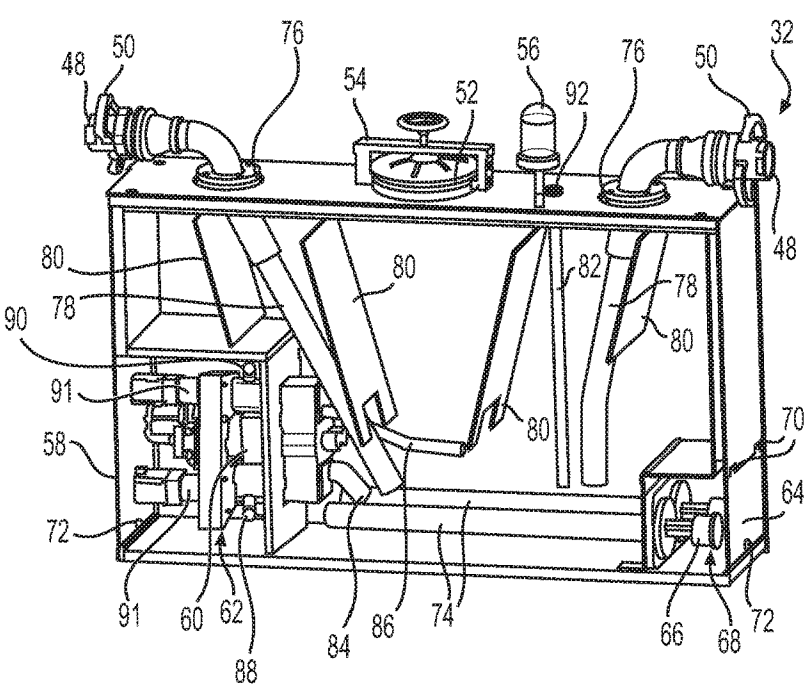
FIG. 3 is a perspective view of an interior of the emulsion fluid tank of FIG. 2, according to aspects of this disclosure.
Figure 2:
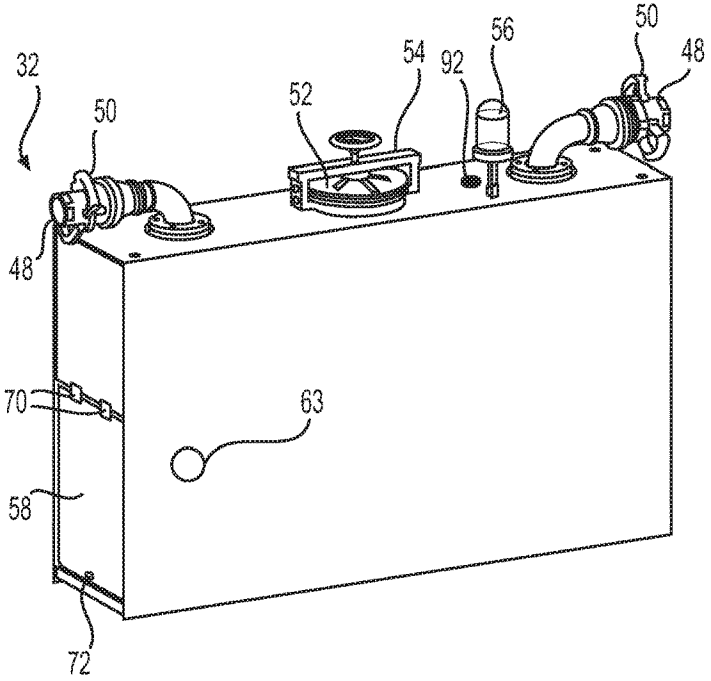
FIG. 2 is a perspective view of an exemplary emulsion fluid tank to be included on the machine of FIG. 1, according to aspects of this disclosure.

As shown in FIGS. 2 and 3, tank 32 may be a substantially rectangular emulsion fluid container. Tank 32 may include one or more inlets 48, for example, one inlet 48 positioned on either side of tank 32 to allow for filling of tank 32 from either side of machine 10. Inlets 48 may include handles 50. Alternatively or additionally, one or more delivery hoses couplable to inlets 48 may include handles to secure the hose to inlet 48 while filling tank 32 with the emulsion fluid. Although not shown, inlets 50 may include a threading or another coupling to secure the delivery hose to one of inlets 48 when filling tank 32. Each of inlets 48 may also include a cap (not shown) to close inlets 48 when not filling tank 32. Tank 32 may also include a access hatch 52, which may be opened to access the interior of tank 32. Access hatch 52 may be positioned between inlets 48, and may be secured in a closed position by a locking bar 54. Tank may include a light 56. Light 56 may be coupled to one or more sensors within tank 32. If the sensors detect, for example, an unsafe pressure, temperature, volume, etc. within tank 32, light 56 may illuminate, flash, or change color to indicate the conditions within tank 32. Additionally, light 56 may be coupled to a siren or other alert device such that the unsafe condition may be indicated both visually and audibly.

Tank 32 may include one or more side panels to access internal cavities within tank. For example, tank 32 may include a pump panel 58 on one side to access a pump 60 in pump cavity 62 (FIG. 3). Pump 60 may also be coupled to one or more tank openings 63, which may be located on opposite sides of tank 32. Furthermore, as shown in FIG. 3, tank 32 may include a heater panel 64 on another side to access one or more heaters 66 in heater cavity 68. Pump panel 58 and heater panel 64 may be pivotable via one or more pivots 70, and may be secured in a closed position by one or more couplings 72, for example, bolts, screw, clips, etc. As such, pump panel 58 and heater panel 64 may provide a user access to portions of pump 60 and heaters 66 from the exterior of machine 10.

FIG. 3 illustrates a perspective view of an internal portion of tank 32. Tank 32 includes a pump 60, one or more heaters 66 positioned in corresponding heater compartments 74, and one or more ports 76 and hoses or tubes 78 connecting inlets 48 to the internal cavity of tank 32. Tank 32 may also include one or more dividers 80 and a sensor rod 82.

Heaters 66 may be resistors, for example, two rods connected on one end to form the circuit. Heaters 66 may be wired or wirelessly connected to control panel 36. The current through heaters 66, and thus the heat delivered to tank 32, may be controllable via control panel 36. Additionally, heaters 66 are positioned within heater compartments 74, which may be generally tube shaped openings that are open and connect to heater cavity 68 at one end and are closed on the other end. In one aspect, heater compartments 74 may include a threading, and heaters 66 may be screwed into place. Alternatively, heaters 66 may be coupled to heater compartments via a friction fit, snap, clip, or other coupling. Heater compartments 74 extend into the internal portion of tank 32, but are fluidly sealed to fluidly isolate heaters 66 and heater cavity 68 from the emulsion fluid contained within tank 32. As such, a user may clean, replace, repair, or otherwise inspect heaters 66 by opening heater panel 64 and removing heaters 66 from heater compartments 74, without draining or otherwise disturbing any emulsion fluid contained within tank 32. As shown in FIG. 3, heater cavity 68 may be positioned in a bottom portion of tank 32 on an opposite side from pump cavity 62.

Tank 32 may also include various dividers 80, which may help to support or limit the movement of ports 76 and tubes 78. Dividers 80 may be coupled to or integrally formed with the interior of tank 32, while still allowing for the emulsion fluid within tank 32 to fluidly move within tank 32. Tank 32 may further include sensor rod 82, which may include one or more pressure, temperature, or volume sensors, for example, temperature sensors positioned along the length of sensor rod 82, such that the temperature and/or volume of the emulsion fluid within tank 32 may be monitored. Sensor rod 82 may be wired or wirelessly connected to control panel 36 and/or to light 56. Furthermore, sensor rod 82 may be removably coupled to tank 32 via a sensor coupling 92 that may, for example, be screwed into a top portion of tank 32 such that sensor rod 82 may be secured extending into tank 32.

Pump 60 may include a plurality of inlets and outlets, and may be a part of the fluid connection between tank 32 and spray bar 34. Pump 60 may be wired or wirelessly connected to control panels 36. Pump 60 may include an internal fluid inlet 84 and an internal fluid outlet 86 positioned within the internal portion of tank 32. Other than internal fluid inlet 84 and internal fluid outlet 86, pump 60 and pump cavity 62 are fluidly isolated from the interior of tank 32. Pump 60 may also include an external fluid inlet 88 and an external fluid outlet 90. In one aspect, external fluid inlet 88 and external fluid outlet 90 may be fluidly connected to exterior components of machine 10 via tank openings 63 (only one opening 63 shown in FIG. 2).

Based on the internal configuration and settings of pump 60, pump 60 may deliver the emulsion fluid from tank 32 to spray bar 34 via internal fluid inlet 84 and external fluid outlet 90, or pump 60 may recirculate the emulsion fluid within tank 32 via internal fluid inlet 84 and internal fluid outlet 86. For example, as detailed below and shown in FIGS. 4A-4E, the configurations and settings of pump 60, in particular, the opening and closing of inlets and outlets 84, 86, 88, and 90, may be controlled by a plurality of tube valves 91. Additionally, pump 60 may deliver additional emulsion fluid from an external source to tank 32 via external fluid inlet 88 and internal fluid outlet 86. Pump 60 may also deliver an additional fluid through the hoses connecting tank 32 to spray bar 34 and through spray bar 34 without passing through tank 32 via external fluid inlet 88 and external fluid outlet 90. For example, pump 60 may be coupled to a cleaning solution supply and pump 60 may deliver the cleaning solution to clean the hoses and spray bar 34. In another aspect, an air compressor may be mounted on machine 10 and coupled to the hoses and spray bar 34 to deliver pressurized air to clean the hoses and spray bar 34. The air compressor may be powered by engine assembly 22.

Pump 60 may be controllable via control panels 36 to selectively direct the fluid flow between pump inlets 84 and 88 and outlets 86 and 90 via tube valves 91. Pump 60 may also be manually operated, for example, by opening pump panel 58 and turning levers or other inputs to program the desired configuration, achieving similar functions as control panel 36. It is noted that the manual operations may be performed to control pump 60 because pump cavity 62 is fluidly isolated from the interior of tank 32. As discussed below, pump 60 may include various indications, for example, different colors, to indicate to a user the rotational position of the tube valves 91 and thus the direction of fluid flow through pump 60. In one aspect, external fluid outlet 90 may be coupled to a hose or tube connected to spray bar 34 in the front of tank 32 or through the rear of tank 32 via tank opening 63.

Although not shown, a filter may be included to filter or clean the emulsion fluid being delivered from tank 32 to spray bar 34. Tank 32 may also include a manual drain element, for example, a manually operated valve element to at least partially empty tank 32. Additionally, tank 32 may include a pressure relief valve, which may be automatically opened if a pressure or other condition within tank 32, for example, measured by sensor rod 82 is unsafe.

FIGS. 4A-4E illustrate various configurations of pump 60. Pump 60 may be a gear pump or any other conventional pump, and may include a valve system having a pair of tube valves 91 on opposite sides of the gears of pump 60. A first valve stem 94 and a second valve stem 96 are located at one end of tube valves 91 and serve to selectively control tube valves 91 in order to open and close internal fluid inlet 84, internal fluid outlet 86, external fluid inlet 88, and external fluid outlet 90. Pump 60 may also include a pump drive motor 98, which may control the activation or deactivation of pump 60, as well as solenoid motors 100 for driving tube valves 91 via valve stems 94 and 96. First valve stem 94 may be rotatable to toggle between, at least, internal fluid inlet 84 being open, external fluid inlet 88 being open, both being open, or both being closed. Second valve stem 96 may be rotatable to toggle between, at least, internal fluid outlet 86 being open, external fluid outlet 90 being open, both being open, or both being closed. Solenoid motors 100 may be wired or wirelessly coupled to control panels 36, for example, via a controller element (not shown), in order to controllably rotate (e.g., by a chain and sprocket connection) tube valves 91 to selectively open and close internal fluid inlet 84, internal fluid outlet 86, external fluid inlet 88, and external fluid outlet 90. For example, tube valves 91 may include respective first and second sprockets 95 and 97 to engage with a chain, gears, or other drive elements. First valve stem 94 and second valve stem 96 may also be manually operable (e.g., rotatable) via a user accessing pump 60 via pump panel 58.

Figure 4A:
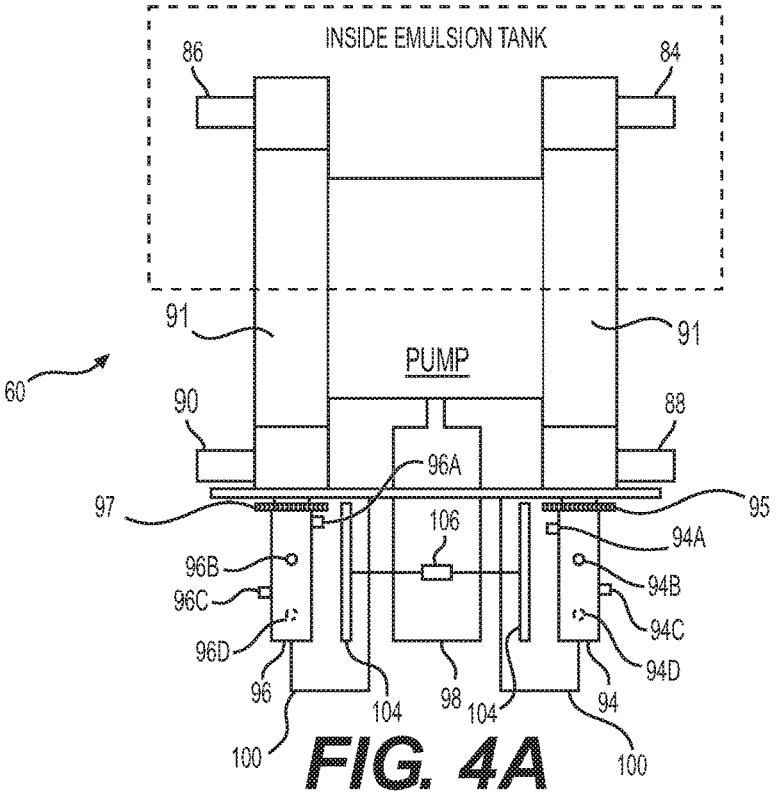
FIGS. 4A-4E illustrate schematic views of exemplary configurations of a pump to be included on the machine of FIG. 1, according to aspects of this disclosure.

First valve stem 94 and second valve stem 96 may include, for example, four indicators, with the position of the indicators corresponding to the respective inlets or outlets being open or closed. Additionally, the indicators of first valve stem 94 and second valve stem 96 may include indicia, such as different colors or patterns, to indicate to a user the respective statuses of the inlets 84, 88, and outlets 86, 90. In one aspect, first valve stem 94 may include a first indicator 94A, a second indicator 94B, a third indicator 94C, and a fourth indicator 94D, and second valve stem 96 may include a first indicator 96A, a second indicator 96B, a third indicator 96C, and a fourth indicator 96D. Each indicator may be formed by a protrusion, and the protrusion from the respective indicator on each valve stem 94, 96 may interact with a corresponding sensor 104, for example, one sensor 104 for each valve stem 94, 96. Sensors 104 may include Hall effect sensors to detect when an indicator on each valve stem 94, 96 is located adjacent to or is facing sensor 104. For example, as shown in FIG. 4A, first indicator 94A and first indicator 96A may each be facing respective sensors 104, so sensors 104 may detect that both tube valves 91 are in closed configurations. Sensors 104 may be connected to a communication unit 106, which may be wired or wirelessly connected to the controller element and control panel 36. Sensors 104 may also include colors, patterns, or other indicia at positions proximate to the various indicators on valve stems 94 and 96 to indicate respective positions of tube valves 91. Although not shown, pump panel 58, pump 60, or pump cavity 62 may also include a key or visual guide to indicate to a user the correlation of the colors, patterns, or indicia to the various pump statuses.

As mentioned, FIG. 4A illustrates pump 60 in a closed configuration. As shown, first valve stem 94 may be in a first position with first indicator 94A facing one sensor 104. Second valve stem 96 may be in a first position with first indicator 96A facing the other sensor 104. In such a configuration, internal fluid inlet 84, internal fluid outlet 86, external fluid inlet 88, and external fluid outlet 90 are all closed, and there is no fluid passing through pump 60.

Figure 4B:
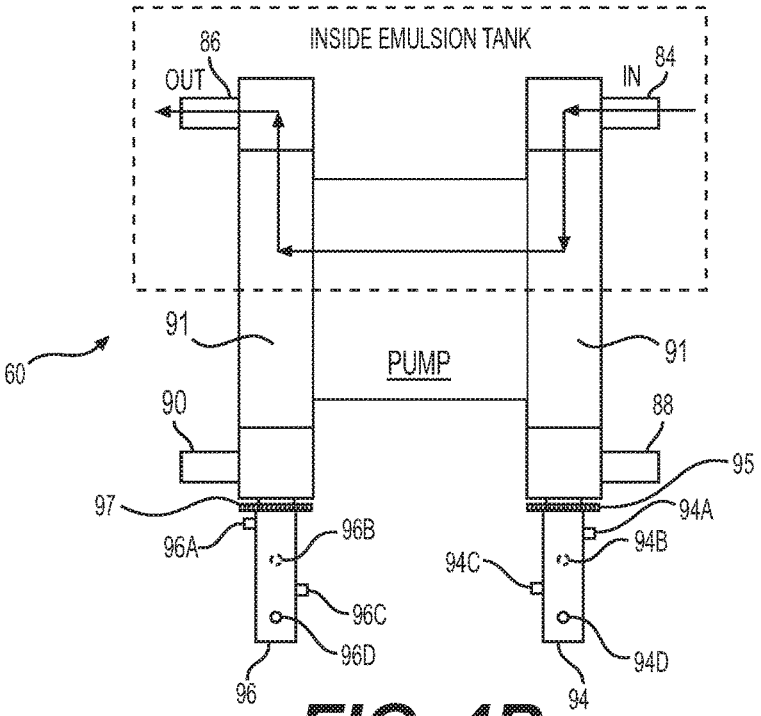

FIG. 4B illustrates pump 60 (with certain components not shown for clarity) in an internal recirculation configuration. As shown, first valve stem 94 may be rotated by solenoid motor 100 to be in a third position with third indicator 94C facing one sensor 104. Second valve stem 96 may be rotated to a third position with third indicator 96C facing the other sensor 104. In such a configuration, internal fluid inlet 84 is open, and internal fluid outlet 86 is also open. External fluid inlet 88 and external fluid outlet 90 are both closed. In this arrangement, emulsion fluid within tank 32 is recirculated through pump 60 and back into tank 32, which may help to maintain a constant temperature throughout the emulsion fluid within tank 32 and/or help to reduce the likelihood of clogs forming in pump 60.

Figure 4C:
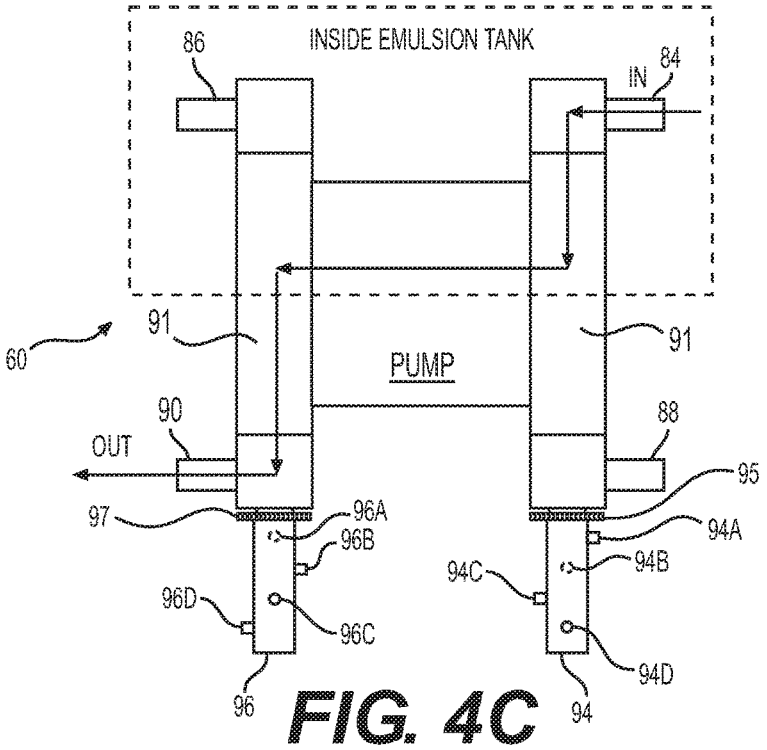

FIG. 4C illustrates pump 60 in a emulsion fluid delivery configuration. As shown, first valve stem 94 may be rotated by solenoid motor 100 to be in the third position with third indicator 94C facing one sensor 104. Second valve stem 96 may be rotated to a second position with second indicator 96B facing the other sensor 104. In such a configuration, internal fluid inlet 84 is open, and external fluid outlet 90 is also open. Internal fluid outlet 86 and external fluid inlet 88 are both closed. In this arrangement, emulsion fluid is delivered from tank 32, through pump 60, and to spray bar 34 to treat a ground surface, which may help to ensure that the delivered paving material properly binds to the ground surface.

Figure 4D:
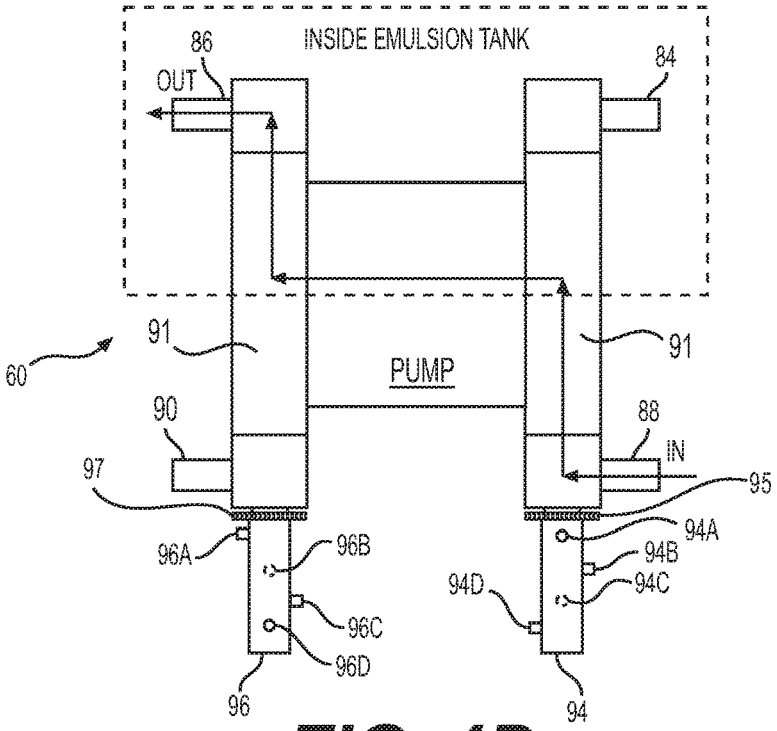

FIG. 4D illustrates pump 60 in an emulsion fluid loading configuration. As shown, first valve stem 94 may be rotated by solenoid motor 100 to be in a fourth position with fourth indicator 94D facing one sensor 104. Second valve stem 96 may be rotated to the third position with third indicator 96C facing the other sensor 104. In such a configuration, external fluid inlet 88 is open, and internal fluid outlet 86 is also open. Internal fluid inlet 84 and external fluid outlet 90 are both closed. In this arrangement, emulsion fluid or another fluid may be delivered from an external source coupled to external fluid inlet 88, and pump 60 may convey the fluid into tank 32, which may refill or otherwise treat the interior of tank 32.

Figure 4E:
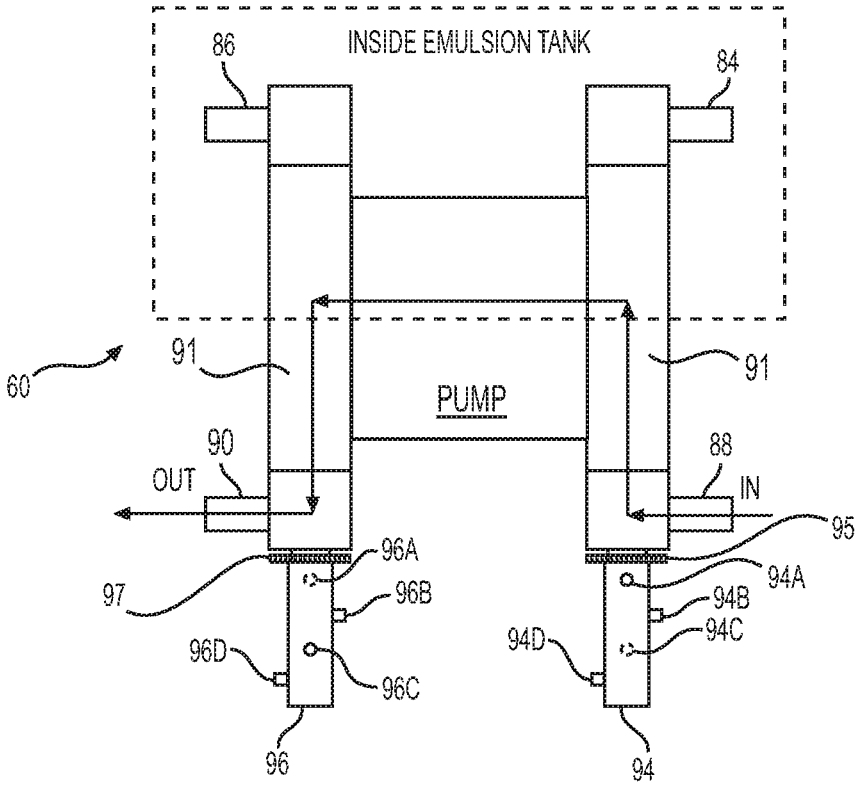

FIG. 4E illustrates pump 60 in an external aspiration configuration. As shown, first valve stem 94 may be rotated by solenoid motor 100 to be in the fourth position with fourth indicator 94D facing one sensor 104. Second valve stem 96 may be rotated to the second position with second indicator 96B facing the other sensor 104. In such a configuration, external fluid inlet 88 is open, and external fluid outlet 90 is also open. Internal fluid inlet 84 and internal fluid outlet 86 are both closed. In this arrangement, a supply of compressed air may be coupled to spray bar 34 via one or more tubes, and the compressed air may be delivered through the tubes and spray bar 34 to ensure any emulsion fluid in the tubes and spray bar 34 is delivered, thereby flushing the system of emulsion fluid. Alternatively, external fluid inlet 88 may be coupled to a supply of cleaning fluid, for example, gasoline, and pump 60 may convey the cleaning fluid through the tubes and spray bar 34, which may help to clean or otherwise treat the internal components of the emulsion fluid delivery system and spray bar 34.

Although not shown, pump 60 may also include a configuration where internal fluid inlet 84, internal fluid outlet 86, external fluid inlet 88, and external fluid outlet 90 are all open. Such a configuration may be used to test, flush, clean, or otherwise treat pump 60.

INDUSTRIAL APPLICABILITY

The disclosed aspects of machine 10 may be used in any paving machine to assist in delivery of paving material. During operation, the user may selectively control pump 60, for example, via control panel 36, in order to recirculate the emulsion fluid within tank 32, to deliver the emulsion fluid from tank 32 to spray bar 34, to refill tank 32, or to deliver air or another fluid through the emulsion delivery lines and spray bar 34. Additionally, a user may vary the configurations of pump 60 either via control panel 36 or by accessing pump 60 directly via pump panel 58. In either aspect, the user may access, configure, or otherwise inspect pump 60 without disassembling, draining, or otherwise opening or draining the emulsion fluid from tank 32 because pump cavity 62 is fluidly isolated from the interior of tank 32.

Tank 32 may also allow a user to deliver emulsion fluid without relying on a secondary machine, such as, for example, a tanker pushed ahead of machine 10. Tank 32 may be filled from either side of machine 10 using inlets 48. Alternatively or additionally, machine 10 may include or may be coupled to a supply of another treatment fluid, a cleaning fluid, or another fluid, and pump 60 may control the delivery of the fluid to either tank 32 or directly to spray bar 36. The position of tank 32 does not interfere with the operation of machine 10, as sightline 40 of operator 42 in operator station 20 is not impaired (FIG. 1).

Furthermore, a user may clean, replace, repair, or otherwise inspect heaters 66 without disassembling, draining, or otherwise opening tank 32. A user may access heaters 66 via heater panel 64, and unscrew or otherwise uncouple heaters 66 from heater compartments 74 within heater cavity 68. Because heater compartments 74 and heater cavity 68 are fluidly isolated from the interior of tank 32, maintenance of heaters 66 may be quicker and easier without the need to disassemble, drain, or otherwise open tank 32, thus not affecting the emulsion fluid in tank 32.

It will be apparent to those skilled in the art that various modifications and variations can be made to the disclosed machine without departing from the scope of the disclosure. Other embodiments of the machine will be apparent to those skilled in the art from consideration of the specification and practice of the paving machine with an emulsion tank disclosed herein. It is intended that the specification and examples be considered as exemplary only, with a true scope of the disclosure being indicated by the following claims and their equivalents.

What is claimed is:

1. A paving machine, comprising:

an engine assembly;

a hopper positioned in a forward portion of the paving machine to receive or store paving material; and a tank to store and dispense emulsion fluid, wherein the tank is positioned between the engine assembly and the hopper, wherein the tank includes a heater cavity and a pump cavity that both extend from a bottom wall of the tank, wherein the pump cavity is fluidly isolated from an interior of the tank, and wherein the pump cavity is accessible from an exterior of the tank via a pump panel located on the side of the paving machine.

2. The paving machine of claim 1, wherein the heater cavity is fluidly isolated from an interior of the tank.

3. The paving machine of claim 2, wherein the heater cavity is accessible from an exterior of the tank via a heater panel located on a side of the paving machine.

4. The paving machine of claim 3, wherein the heater cavity is connected to one or more heater compartments that extend into the interior of the tank to receive one or more heater elements from the heater cavity to heat the emulsion fluid stored within the tank, and wherein the heater compartments are fluidly isolated from the interior of the tank.

5. The paving machine of claim 1, wherein the pump cavity includes a pump that includes a plurality of inlets and outlets in order to fluidly couple the tank to an emulsion spray bar or to an external fluid supply.

6. The paving machine of claim 5, wherein the pump includes an internal fluid inlet and an internal fluid outlet fluidly connected to the interior of the tank, and wherein the pump includes an external fluid inlet and an external fluid outlet that are positioned exterior to the tank.

7. The paving machine of claim 6, wherein the pump includes one or more tube valves that are movable to configure the fluid flow to and from the pump, and wherein each tube valve includes a plurality of indicators positioned on a tube valve stem; and further including one or more sensors positioned adjacent to the pump, wherein the one or more sensors detect the configurations of the one or more tube valves.

8. The paving machine of claim 7, wherein the pump is controllable to recirculate the emulsion fluid within the tank, to deliver the emulsion fluid from the tank to the emulsion spray bar, to deliver a fluid from an exterior source to the tank, and to deliver the fluid from the exterior source directly to the emulsion spray bar without passing through the tank.

9. The paving machine of claim 8, further including a supply of compressed air, and wherein the supply of compressed air is coupled to the emulsion spray bar.

10. The paving machine of claim 1, further including at least two fluid inlets positioned on a top portion of the tank, and wherein the at least two fluid inlets are positioned on opposite sides of the tank relative to a central axis of the paving machine.

11. The paving machine of claim 10, wherein the at least two fluid inlets are each coupled to a tube that extends into an interior of the tank, and wherein one or more dividers are coupled to the interior of the tank to support or separate the tubes.

12. The paving machine of claim 1, further including at least one sensor positioned within the tank, wherein the at least one sensor is connected to a light positioned outside of the tank, and wherein when the sensor detects a condition outside of a predetermined range, the light illuminates or changes color to indicate the sensed condition.

13. A paving machine, comprising:

an engine assembly;

a hopper positioned in a forward portion of the paving machine to receive or store paving material; and a tank to store and dispense emulsion fluid, wherein the tank is positioned between the engine assembly and the hopper, wherein the tank includes a heater cavity positioned on a side portion of the tank, wherein the heater cavity is connected to one or more heater compartments that extend into an interior cavity of the tank, and wherein the heater cavity and heater compartments are fluidly isolated from the interior cavity, wherein the tank includes a pump cavity that is accessible via a pump panel located on a side of the paving machine, and wherein one or more of the pump cavity and the heater cavity extend from a bottom wall of the tank.

14. The paving machine of claim 13, wherein the pump cavity is positioned on another side portion of the tank, wherein the pump cavity is fluidly isolated from the interior cavity, and wherein the pump cavity includes a pump with a plurality of inlets and outlets in order to fluidly couple the interior cavity of the tank to a spray bar or to an external fluid supply.

15. The paving machine of claim 14, wherein both the heater cavity and the pump cavity extend from a bottom wall of the tank.

16. A paving machine, comprising:

an engine assembly;

a hopper to receive or store paving material;

a tank positioned between the engine assembly and the hopper to store and dispense emulsion fluid; and at least two fluid inlets positioned on a top portion of the tank, wherein the at least two fluid inlets are positioned on opposite sides of a top portion of the tank relative to a central axis of the paving machine, wherein each of the at least two fluid inlets are coupled to respective tubes that extend into an interior of the tank, and wherein one or more dividers are coupled to the interior of the tank to support or separate the tubes.

17. The paving machine of claim 16, wherein the tank includes a heater cavity positioned on a side portion of the tank, wherein the heater cavity is connected to one or more heater compartments that extend into the interior cavity of the tank, and wherein the heater cavity and heater compartments are fluidly isolated from the interior cavity.

* * * * *